US008201718B1

(12) United States Patent
Vargas-Lebron

(10) Patent No.: US 8,201,718 B1
(45) Date of Patent: Jun. 19, 2012

(54) KNEEBOARD FOR PILOTS

(76) Inventor: Pedro J. Vargas-Lebron, Tucson, AZ (US)

( * ) Notice: Subject to any disclaimer, the term of this patent is extended or adjusted under 35 U.S.C. 154(b) by 590 days.

(21) Appl. No.: 12/378,351

(22) Filed: Feb. 13, 2009

(51) Int. Cl.

| | |
|---|---|
| ***A45F 3/14*** | (2006.01) |
| ***A45C 13/30*** | (2006.01) |
| ***B65D 27/00*** | (2006.01) |
| ***B65D 30/00*** | (2006.01) |
| ***B65D 30/22*** | (2006.01) |

(52) U.S. Cl. ..... 224/222; 229/67.1; 383/37; 383/38

(58) Field of Classification Search ..... 224/222; 229/67.1

See application file for complete search history.

(56) References Cited

U.S. PATENT DOCUMENTS

| | | | | | |
|---|---|---|---|---|---|
| 2,420,673 | A * | 5/1947 | Monrad | 40/446 |
| 2,876,022 | A * | 3/1959 | Kroviak | 108/43 |
| 3,232,685 | A * | 2/1966 | Wilstein et al. | 108/23 |
| 3,407,757 | A * | 10/1968 | Warner | 108/43 |
| 3,589,327 | A * | 6/1971 | Jacobs | 116/39 |
| 4,365,433 | A * | 12/1982 | Buell | 40/391 |
| 5,779,211 | A * | 7/1998 | Bird | 248/346.01 |
| 5,937,765 | A * | 8/1999 | Stirling | 108/43 |
| 6,269,948 | B1 * | 8/2001 | Jackson | 206/320 |
| 6,662,733 | B1 * | 12/2003 | Scott | 108/43 |
| 7,281,877 | B1 * | 10/2007 | Lederer et al. | 402/73 |
| 2003/0000987 | A1 * | 1/2003 | Barr | 224/661 |
| 2006/0008320 | A1 * | 1/2006 | Spaulding | 402/79 |
| 2009/0265050 | A1 * | 10/2009 | Burpee | 701/16 |

* cited by examiner

*Primary Examiner* — Nathan J Newhouse
*Assistant Examiner* — Derek Battisti
(74) *Attorney, Agent, or Firm* — Montgomery Patent & Design, LLC; Robert C. Montgomery; Joseph T. Yaksich

(57) ABSTRACT

A modular pilot kneeboard system with detachable and interchangeable side pockets and accessories is herein disclosed. Each side edge of a main base plate is equipped with a zipper edge that allows add-on pieces, each with a mating zipper edge, to be zippered onto the main base plate and folded over like a conventional binder. Such side pieces are envisioned to provide pockets, straps, compartments and the like to hold additional items such as flight calculators, GPS systems flashlights, pens, and virtually any item a pilot may need quick access to during a flight. These items can attach by the aforementioned zippers, hook-and-loop fasteners, snaps, elastic bands, clips and the like.

20 Claims, 4 Drawing Sheets

KNEEBOARD FOR PILOTS

RELATED APPLICATIONS

The present invention was first described in a notarized Official Record of Invention on Jun. 29, 2007, that is on file at the offices of Montgomery Patent and Design, LLC, the entire disclosures of which are incorporated herein by reference.

FIELD OF THE INVENTION

The present invention relates generally to a kneeboard system for pilots.

BACKGROUND OF THE INVENTION

Airplane pilots frequently use a kneeboard comprising a flat board fastened to the upper leg or thigh area using a strap around the leg. This device allows a pilot to refer to charts, write on a pad, refer to documents and checklists, and perform other similar procedures in crowded cockpits where horizontal flat surfaces are at a premium. As would be expected, manufacturers have responded with all different types of kneeboards that cover IFR or VFR usage, comprise bifold or tri-fold versions, among others. However, every pilot's needs and wants are different, and as such, compromises are typically made when purchasing a specific kneeboard. Pilots often have to modify individual kneeboards to suit their needs, often with results that are not professional looking or aesthetically pleasing. Accordingly, there exists a need for a means by which pilot kneeboards can be individually customized to suit exact requirements without the disadvantages as described above. The development of the device described herein fulfills this need.

There have been attempts in the past to invent kneeboard devices. U.S. Pat. No. 6,050,201 issued to Blanchard discloses a swiveling automotive kneeboard has a base, a writing plate, a memo pad clip, and an elastic strap with hook-and-loop fastening material that appears to attach to a user's thigh or a steering wheel. Unfortunately, this patent does not appear to disclose a kneeboard for pilots that comprises a clipboard and a plurality of user selectable modules that may be zippered onto a main center module to customize the kneeboard to a user's preferences.

U.S. Pat. No. 5,615,817 issued to Shevers discloses a kneeboard with an extending ear to support a hand-held avionics instrument conveniently astride the working surface of the kneeboard. Unfortunately, this patent does not appear to disclose a kneeboard for pilots that possess a plurality of attachable modules to store items.

U.S. Pat. No. D 267,809 issued to Lowery et al. discloses a clipboard with two (2) clips. Unfortunately, this design patent does not appear to be similar in appearance to the disclosed device, nor does it appear to disclose a kneeboard for pilots that utilize an adjustable strap to attach to the upper thigh region of a pilot.

U.S. Pat. No. D 164,269 issued to Whittier discloses a clip board that appears to comprise a clip board that attaches by means of a strap around the leg of a pilot. Unfortunately, this design patent does not appear to be similar in appearance to the disclosed device, nor does it appear to disclose a kneeboard for pilots that permit the attachment of user selectable modules to customize the kneeboard for usage.

U.S. Pat. No. 3,232,685 issued to Wilstein discloses a pilot's kneeboard that appears to comprise a clipboard and a holder for a writing instrument that attaches around the thigh of a user. Unfortunately, this patent does not appear to disclose a kneeboard for pilots that comprise a clipboard and a plurality of user selectable modules that may be zipped onto a main center module to customize the kneeboard to a user's preferences.

U.S. Pat. No. 3,215,453 issued to Malcolm discloses a flight log and approach chart presentation apparatus that may be strapped to the thigh of a user. Unfortunately, this patent does not appear to disclose a kneeboard for pilots that comprises a customizable kneeboard with a plurality of attachable modules that may be conveniently folded and carried when not in use.

U.S. Pat. No. 2,420,673 issued to Monrad discloses a navigation device that attaches by means of a strap to the thigh of a user. Unfortunately, this patent does not appear to disclose a kneeboard for pilots that comprises a clipboard and a plurality of user selectable modules that may be zipped onto a main center module to customize the kneeboard to a user's preferences.

SUMMARY OF THE INVENTION

In light of the disadvantages as previously discussed in the prior art, it is apparent that there is a need for a kneeboard for pilots that is user customizable.

An object of the kneeboard for pilots comprises an attachment means at an upper thigh area of a user by means of an adjustable strap and provides a necessary horizontal writing surface that is typically not available in a cockpit.

Another object of the kneeboard for pilots, comprises specific modules that can be chosen by a user based upon personal preference, type of aircraft being flown, route or environment being flown in, among other factors.

A further object of the kneeboard for pilots is to provide modules that provide storage for additional items such as flight calculators, GPS systems flashlights, pens, or other items a pilot may require quick access to during a flight.

Still another object of the kneeboard for pilots allows the pilot quick access to the user-customizable kneeboard at all times regardless of seating position or stance.

Still a further object of the kneeboard for pilots is an adjustable nature so that the kneeboard will work for any size pilot as well as over any type of clothing that may be worn.

Yet a further object of the kneeboard for pilots comprising a construction of durable textile such as nylon or leather that is formed over and attached to a durable substrate surface such as plastic or heavy cardboard, thereby providing durability thereof the kneeboard for pilots in the event of exposure to inclement weather conditions.

Yet another object of the knee board for pilots comprises attachable modules of varied functionality that may be provided with a series of elastic straps that could be used to hold handheld instrumentation, identification clips, keys, or writing instruments or possess a series of pockets for holding items such as clips, small electronic devices such as portable music players, radios, a personal digital assistant (PDA), or a calculator.

Still another object of the kneeboard for pilots is that it may be adapted by a user to accommodate both left and right hand dominant users.

Still a further object of the kneeboard for pilots prohibits, due to the captive nature of the adjustable strap, the possibility of the kneeboard opening or contained items becoming dislodged when not in use.

An aspect of the kneeboard for pilots comprises a main center module, a left attachable module, a top attachable module, and a right attachable module. The main center module is located in the center and comprises an adjustable strap with a quick release buckle system. The main center module comprises a clipboard and a receiving zipper segment which mates with a locking zipper mechanism to form a three-sectioned folding assembly for compact storage and transportation.

A further aspect of the kneeboard for pilots comprises a left attachable module and a right attachable module which depend down from the kneeboard when the main center module rests atop the upper thigh area.

Still a further aspect of the kneeboard for pilots comprises side margin areas on each side of the clipboard and a slot for the purposes of holding a writing instrument. The lower section of the side margin area is covered with a mating surface of a hook-and-loop fastening system, thereby holding additional items such as a portable clock, additional storage modules, or a ring binding system to hold checklists.

A method of installing and utilizing the kneeboard for pilots may be accomplished by performing the following steps: selecting the desired modules; attaching the desired modules to the main center section using the receiving zipper segment and the locking zipper mechanism; loading desired personal items kneeboard for pilots thus preparing it for usage; deploying the knee board for pilots by placing the kneeboard upon the upper thigh area in the desired area; unfastening the quick release buckle system; wrapping the adjustable strap around the upper thigh area; securing the adjustable strap using the quick release buckle system; unfolding the attachable modules so that access may be had to the clipboard contained in the main center section; utilizing the kneeboard as needed; stowing the kneeboard by reversing the above steps and storing until need for further usage; and benefiting from the added convenience of being able to locate needed items and the reduced frustration of utilizing the kneeboard for pilots.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | user-customizable kneeboard for pilots |
| 15 | pilot |
| 20 | upper thigh area |
| 25 | adjustable strap |
| 30 | main center module |
| 35 | left attachable module |
| 40 | top attachable module |
| 45 | right attachable module |
| 50 | cockpit |
| 55 | quick release buckle system |
| 60 | clipboard |
| 65 | receiving zipper segment |

-continued

| DESCRIPTIVE KEY | |
|---|---|
| 70 | locking zipper mechanism |
| 75 | elastic straps |
| 80 | pockets |
| 85 | side margin area |
| 90 | slot |
| 95 | hook-and-loop fastening system |
| 100 | ring binding system |

DETAILED DESCRIPTION OF THE PREFERRED EMBODIMENT

Figure 1:
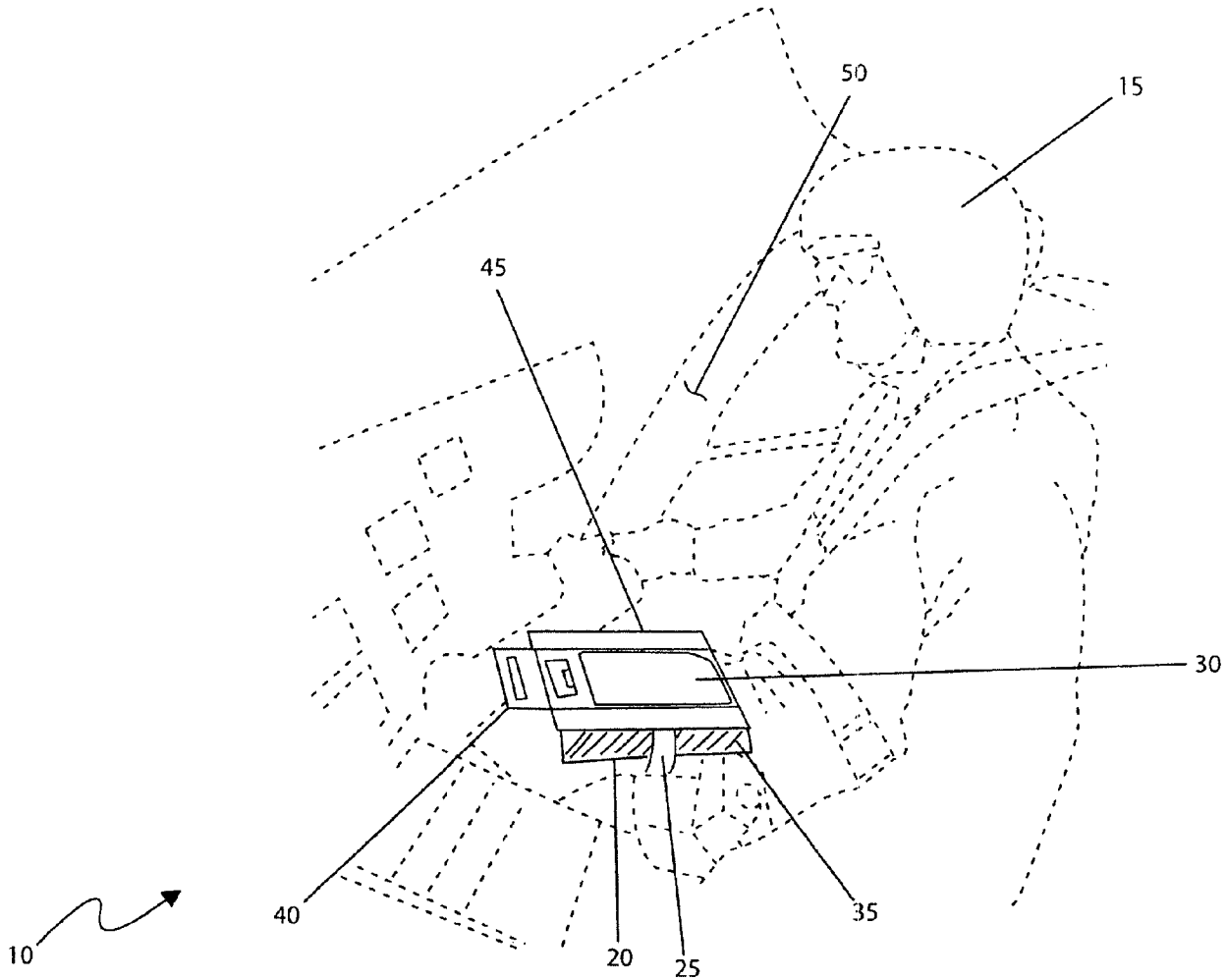
FIG. 1 is a pictorial representation of the user-customizable kneeboard for pilots 10 in a utilized state by a pilot 15, according to the preferred embodiment of the present invention.
Figure 2A:
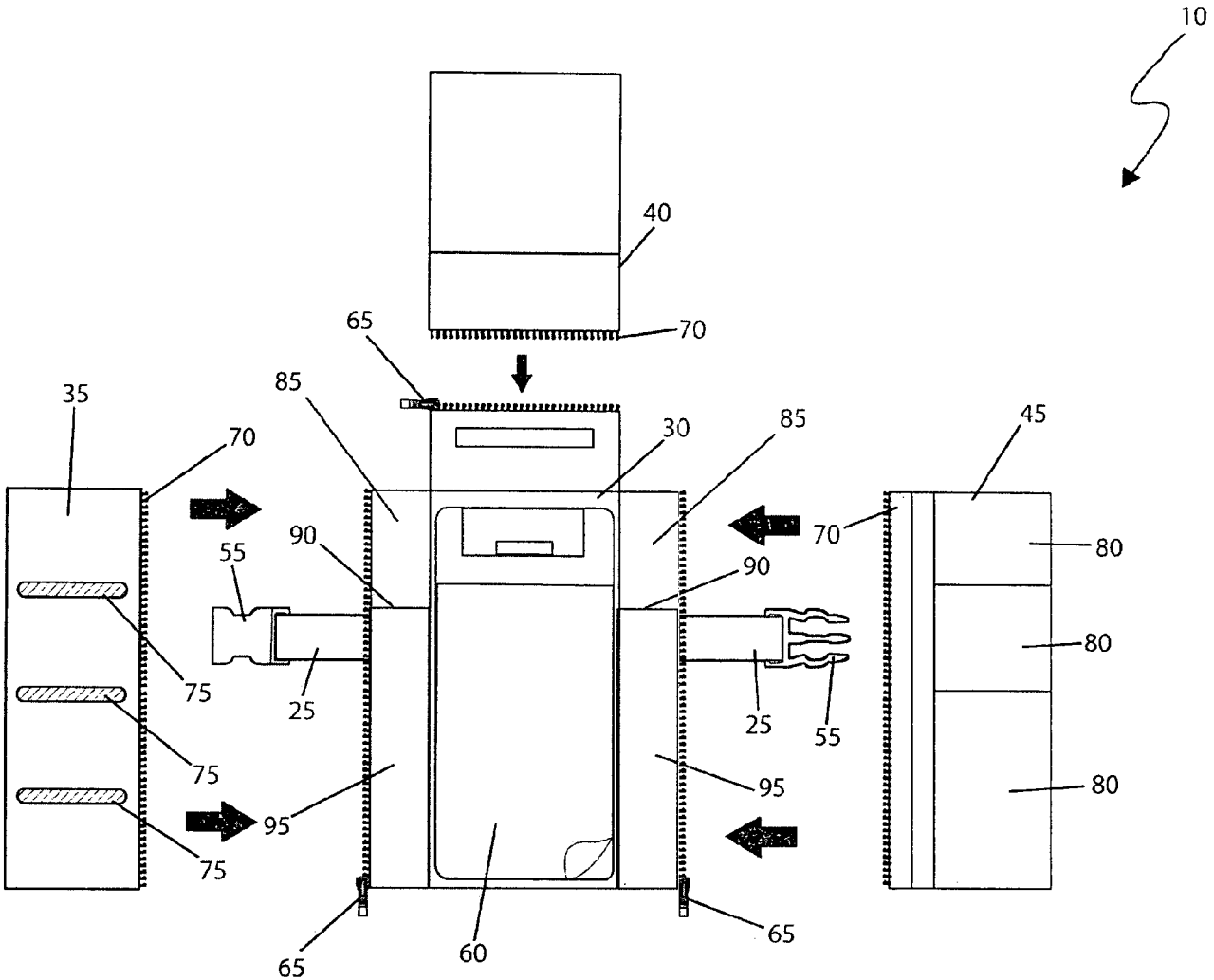
FIG. 2*a* is an exploded view of the user-customizable kneeboard for pilots 10.
Figure 2B:
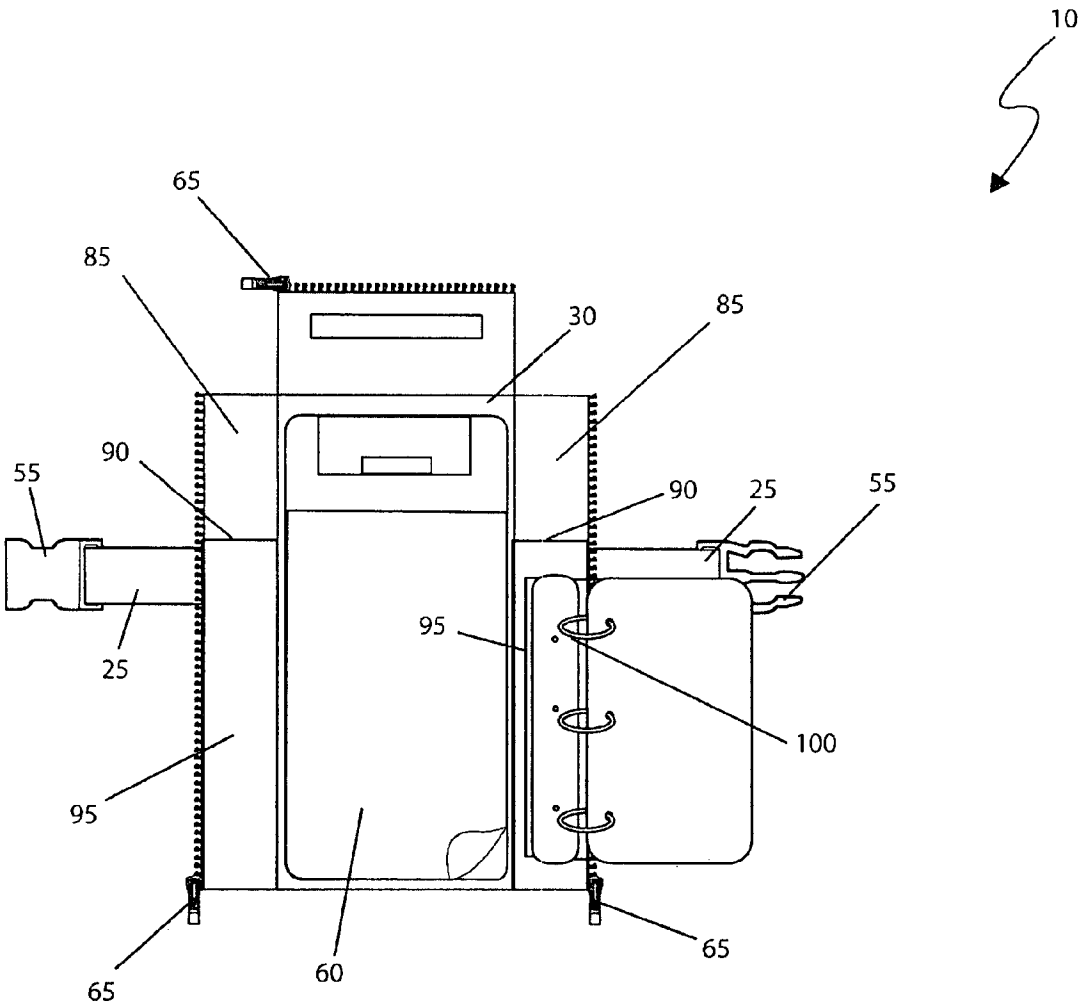
FIG. 2*b* is a top view of the user-customizable kneeboard for pilots 10 with a ring binding system 100 attached; and, FIG. 3 is an isometric view of the user-customizable kneeboard for pilots 10 in its folded or stowed state.
Figure 3:
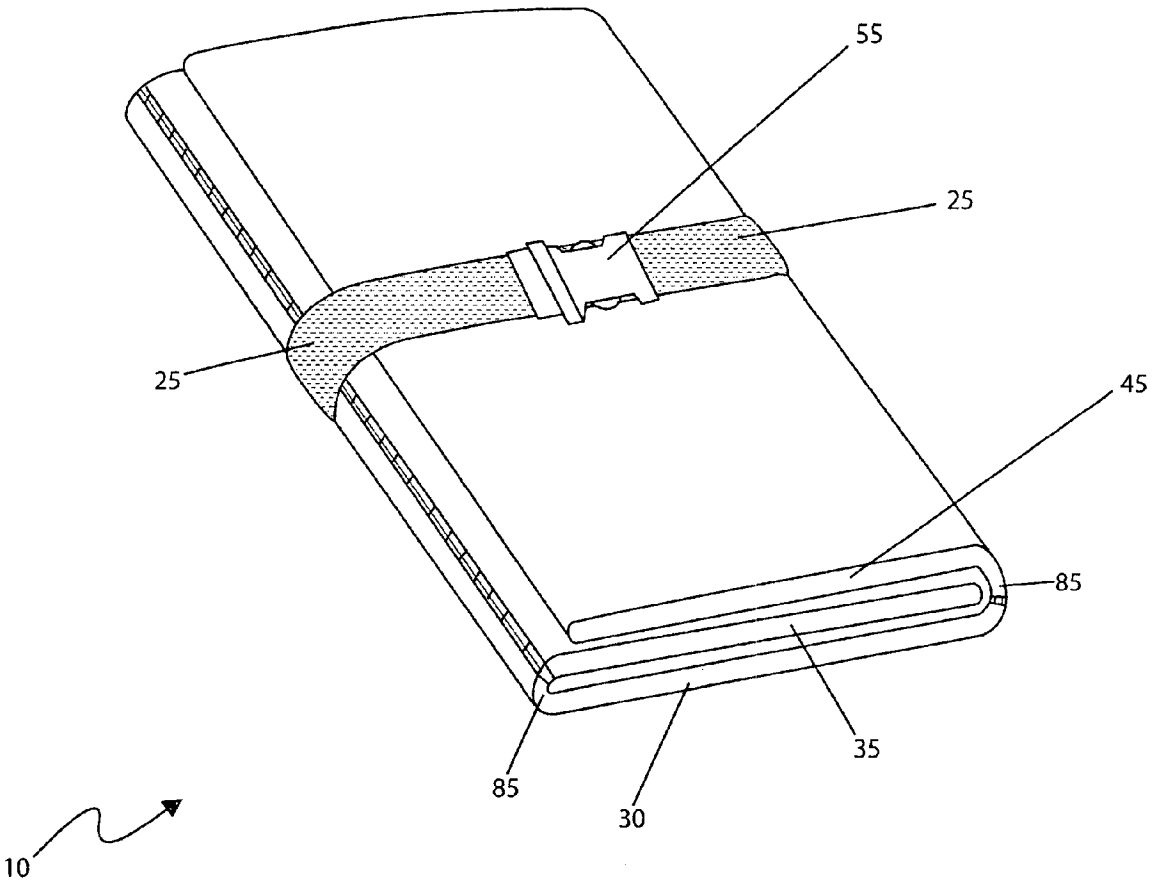

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a pictorial representation of the user customizable kneeboard for pilots 10 in a utilized state by a pilot 15, according to the preferred embodiment of the present invention is disclosed. The user-customizable kneeboard for pilots 10 is attached at the upper thigh area 20 by use of an adjustable strap 25. Further disclosure on the construction of the adjustable strap 25 will be provided herein below. The user-customizable kneeboard for pilots 10 is shown used on the left leg of the pilot 15 for illustrative purposes and can be used on either leg with equal effectiveness. The user-customizable kneeboard for pilots 10 comprises a main center module 30, a left attachable module 35, a top attachable module 40, and a right attachable module 45 (not fully visible in this FIG.). Said modules are selected and utilized by the pilot 15 by personal preference, type of aircraft being flown, route or environment being flown in and other factors. Said modules are envisioned to provide storage ability to hold additional items such as flight calculators, GPS systems flashlights, pens, and virtually any item a pilot may need quick access to during a flight. Such features allow the pilot 15 quick access to the user-customizable kneeboard for pilots 10 at all times regardless of seating position or stance. The user-customizable kneeboard for pilots 10 provides a necessary horizontal writing surface that is typically not available in a cockpit 50.

Referring next to FIG. 2*a*, an exploded view of the user-customizable kneeboard for pilots 10 is depicted. The main center module 30 is located in the center and is provided with the adjustable strap 25. The adjustable strap 25 is attachable by a quick release buckle system 55 that allows the user customizable kneeboard for pilots 10 to be quickly secured in position as shown in FIG. 1, and then quickly removed as needed. The adjustable nature of the adjustable strap 25 ensures that it will work for any size pilot 15 (as shown in FIG. 1) as well as over any type of clothing that may be worn.

The main center module 30 provides for a clipboard 60 of standard design in a central location. The main center module 30 is envisioned to be constructed of durable textile such as nylon or leather that is formed over and attached to a durable substrate surface such as plastic or heavy cardboard. Said covering provides a durable nature to the user-customizable kneeboard for pilots 10 should it be exposed to inclement weather conditions. The sides and top of the main center module 30 are provided with a receiving zipper segment 65, whose functionality may or may not be realized by the pilot 15 (as shown in FIG. 1) depending on the customization level that is utilized. The receiving zipper segment 65 mates with a locking zipper mechanism 70 on each of the left attachable module 35, the top attachable module 40 and the right attachable module 45. In such a manner, the aforementioned components form a three-sectioned folding assembly for compact storage and transportation. During use, the left attachable module 35 hangs down the left side of the upper thigh area 20 (as shown in FIG. 1), the right attachable module 45 hangs down the right side of the upper thigh area 20 (as shown in FIG. 1) while the top attachable module 40 rests atop the upper thigh area 20 (as shown in FIG. 1) above the main center module 30. It is envisioned that the main center module 30, the left attachable module 35, and the top attachable module 40 would be made of the same material and construction as the main center module 30 to further reinforce the customizable, but functionally related nature of the user customizable kneeboard for pilots 10. The exact functionality and nature of the left attachable module 35, the top attachable module 40, and the right attachable module 45 are envisioned to vary widely and are not intended as a limiting factor of the present invention. For purposes of illustration, the left attachable module 35 could be provided with a series of elastic straps 75 that could be used to hold handheld instrumentation, identification clips, keys, writing instruments, and the like. The right attachable module 45 could be provided with a series of pockets 80 for holding items such as clips, small electronic devices such as portable music players, radios, a personal digital assistant (PDA), a calculator or the like. The top attachable module 40 could be used for holding other items such as clocks, a Global Positioning Satellite (GPS) receiver or the like. Such examples are provided to illustrate the functionality of the user-customizable kneeboard for pilots 10 and not as a limiting factor. The location of the functionality can be modified on the user-customizable kneeboard for pilots 10 to suit both left and right handed users. Located atop a side margin area 85 on each side of the clipboard 60 is a slot 90 for the purposes of holding a writing instrument such as a pen or pencil which can be easily reached when needed. The lower section of the side margin area 85 is covered with a mating surface of a hook-and-loop fastening system 95, commonly known as VELCRO®. The hook-and-loop fastening system 95 would be used to hold additional items such as a portable clock, additional storage modules, or the like. Such a securing method ensures that needed items remain close at hand and do not get lost in the cockpit 50 (as shown in FIG. 1) during turbulence or disturbances.

The overall dimensions of the main center module 30 are ten (10) inches in length with eight (8) inches in width. Approximate dimensions of the left attachable module 35 and the right attachable module 45 would be approximately ten (10) inches in height and no more than six (6) inches in width to allow for closing of the user customizable kneeboard for pilots 10. The dimensions of the top attachable module 40 are envisioned to be approximately six (6) inches wide and no more than eight (8) inches tall so as to fit comfortably on the entire length of the upper thigh area 20 (as shown in FIG. 1).

To close the user-customizable kneeboard for pilots 10, the user would first fold the top attachable module 40 downward such that it rests upon the main center module 30. Next, either the left attachable module 35 or the right attachable module 45 would be folded in such that it rests upon the top attachable module 40. Finally, the opposite side module would be folded over on top of the previously folded left attachable module 35 or right attachable module 45. In such a manner the total size of the user-customizable kneeboard for pilots 10 is now only ten (10) inches tall by approximately eight (8) inches wide. The pilot 15 (as shown in FIG. 1) can then disconnect the quick release buckle system 55 and wrap it around the user-customizable kneeboard for pilots 10 such as to secure it in its folded or stowed state as will be shown herein below.

Referring next to FIG. 2*b*, a top view of the user-customizable kneeboard for pilots 10 with a ring binding system 100 attached is depicted. The side margin area 85 and the hook-and-loop fastening system 95 can be used to hold a ring binding system 100 also provided with the opposing mating surface of the hook and loop fastening system 95 to hold checklists. This will allow the checklist to sit atop the clipboard 60 for use, or the associated pages can be flipped over to one side or another to gain access to the clipboard 60.

Referring finally to FIG. 3, an isometric view of the user-customizable kneeboard for pilots 10 in its folded or stowed state is shown. This figure clearly shows the appearance of the user-customizable kneeboard for pilots 10 when not in use. The captive nature of the adjustable strap 25 practically eliminates the possibility of the user-customizable kneeboard for pilots 10 becoming opened or contained items falling out of the user-customizable kneeboard for pilots 10 when not in use. The left attachable module 35 and the right attachable module 45 are shown located above the main center module 30 in a folded state in much the same manner as a conventional binder with multiple panels. The quick release buckle system 55 on the end of the adjustable strap 25 is located along a top surface of the user-customizable kneeboard for pilots 10 such that it can be easily released and utilized when needed. The ring binding system 100 and the clipboard 60 is also visible inside the user-customizable kneeboard for pilots 10 as well.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

It is envisioned that the pilot 15 would select the desired modules that may possibly be used from a catalog, or from a store to suit their particular needs. Additional modules could also be purchased for specific needs such as specific types of aircraft, specific flight patterns and the like. Other possibilities such as a central supply center where a pilot 15 could choose a specific module needed, and return unneeded ones as well are also envisioned. After an appropriate number and type of modules are chosen, the pilot 15 would attach them to the main center module 30 using the receiving zipper segment 65 and the locking zipper mechanism 70. At this point in time, the appropriate personal items would be loaded into the user-customizable kneeboard for pilots 10 thus preparing it for use.

During an actual flight, the pilot 15 would be seated in the cockpit 50 to prepare for flight in the expected manner. To deploy the user-customizable kneeboard for pilots 10, the pilot 15 would place it upon the upper thigh area 20 in the desired area and unfasten the quick release buckle system 55 from atop the user-customizable kneeboard for pilots 10. Next, the adjustable strap 25 would be wrapped around the upper thigh area 20 and secured on the underside using the same quick release buckle system 55. At this point in time; the left attachable module 35 or the right attachable module 45 would be unfolded to the side, the remaining left attachable module 35 or right attachable module 45 unfolded to the opposite side, and the top attachable module 40 would be unfolded to the top. The pilot 15 would utilize the user-customizable kneeboard for pilots 10 in much the same manner as a conventional kneeboard but with the added benefit of all needed items and only the needed items being exactly where needed. Such a feature provides not only reduced aggravation, searching and fumbling, but a safer and more efficient flight.

When completed with use, the user-customizable kneeboard for pilots 10 is refolded using the opposite sequence as described above and secured with the adjustable strap 25 until needed again.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A modular kneeboard system for a user, comprising:

a center module having a top most edge and a side margin, said side margin having a top edge that is spaced from said center module's top most edge, so that the height of said side margin is less than the height of said center module's top most edge;

a left module removably attachable thereto a left periphery edge of said center module;

a right module removably attachable thereto a right periphery edge of said center module;

a top module removably attachable thereto a top periphery edge of said center module; and, a strap located on a rear surface of said center module for removably attaching said system thereto a leg of said user; and, a ring binder and a clip board simultaneously attached to said center module and simultaneously located subjacent to said left and right modules;

wherein said user can configure said system into a desired orientation by detaching and attaching said left module, said right module, and said top module thereto said center module;

wherein said system is readily available thereto said user;

wherein said center module has a top most edge terminating outwardly and away from said top edge of said side margin; and, wherein said top module is directly coupled to said top most edge of said center module and remains spaced from said side margin.

2. The system of claim 1, wherein said center module further comprises a means for said user to write thereon.

3. The system of claim 2, wherein said center module further comprises a nylon material attached thereto a plastic material.

4. The system of claim 2, wherein said center module further comprises a leather material attached thereto a plastic material.

5. The system of claim 2, wherein said center module further comprises a slot for holding a writing instrument.

6. The system of claim 1, wherein said left module further comprise a plurality of pockets to hold a plurality of items.

7. The system of claim 1, wherein said right module further comprises a plurality of pockets to hold a plurality of items.

8. The system of claim 1, wherein said left module further comprise a plurality of straps to hold a plurality of items.

9. The system of claim 1, wherein said right module further comprises a plurality of straps to hold a plurality of items.

10. The system of claim 1, wherein said top module further comprises a means for holding a plurality of items.

11. The system of claim 1, wherein said system further comprises:

a first receiving zipper segment located on said left periphery edge of said center module; and, a first locking zipper mechanism located on a side periphery edge of said left module;

wherein said first locking zipper mechanism removably attaches thereto said first receiving zipper segment.

12. The system of claim 1, wherein said system further comprises:

a second receiving zipper segment located on said right periphery edge of said center module; and, a second locking zipper mechanism located on a side periphery edge of said right module;

wherein said second locking zipper mechanism removably attaches thereto said second receiving zipper segment.

13. The system of claim 1, wherein said system further comprises:

a third receiving zipper segment located on said top periphery edge of said center module; and, a third locking zipper mechanism located on a top periphery edge of said top module;

wherein said third locking zipper mechanism removably attaches thereto said third receiving zipper segment.

14. The system of claim 1, wherein said strap is adjustable.

15. The system of claim 1, wherein said strap comprises a quick release buckle.

16. The system of claim 14, wherein said system further comprises:

a hook portion located along said right periphery edge or said left periphery edge of said center module; and, a loop portion located on a rear surface of said ring binder;

wherein said loop portion removably attaches thereto said hook portion.

17. The system of claim 15, wherein other items can comprise said loop portion to be removably attached thereto said hook portion.

18. The system of claim 1, wherein said center module is approximately ten (10) inches in length and eight (8) inches in width.

19. The system of claim 1, wherein each of said left module and said right module are approximately ten (10) inches in length and six (6) inches in width.

20. A method for using a modular kneeboard system for a user, said method comprising the steps of:

providing said system, comprising:

a center module having a top most edge and a side margin, said side margin having a side margin top edge that is spaced from said center module's top most edge, so that the height of said side margin is less that the height of said center module's top most edge, and wherein said center module has a top most edge terminating outwardly and away from said top edge of said side margin; and wherein said top module is directly coupled to said top most edge of said center module and remains spaced from said side margin;

a left module removably attachable thereto a left periphery edge of said center module;

a right module removably attachable thereto a right periphery edge of said center module;

a top module removably attachable thereto a top periphery edge of said center module; and, a strap located on a rear surface of said center module for removably attaching said system thereto a leg of said user;

wherein said user can configure said system into a desired orientation by detaching and attaching said left module, said right module, and said top module thereto said center module;

selecting between said left module, said right module, and said top module to suit a particular need thereof said user;

attaching said selected modules thereto said center module;

loading a plurality of items therein a particular module, thus preparing said system for use;

attaching said system thereto a desired area of said leg of said user using said strap;

unfolding either said left module, said right module, or said top module;

utilizing said system in much the same manner as a conventional kneeboard but with the added benefit of all needed items and only the needed items being exactly where needed; and, removing said system therefrom said leg of said user when finished.

* * * * *